United States Patent [19]

Ackers et al.

[11] 4,090,673

[45] May 23, 1978

[54] CENTRIFUGAL IMPACT ROCK CRUSHERS

[75] Inventors: Stephen B. Ackers, Portland, Oreg.; Neil M. Rose, Vancouver, Wash.

[73] Assignee: Canica Crushers Ltd., Vancouver, Wash.

[21] Appl. No.: 769,908

[22] Filed: Feb. 18, 1977

[51] Int. Cl.[2] ..... B02C 23/00

[52] U.S. Cl. ..... 241/275

[58] Field of Search ..... 241/275, 300, DIG. 10

[56] References Cited

U.S. PATENT DOCUMENTS

| | | | |
|---|---|---|---|
| 3,149,793 | 9/1964 | Bridgewater | 241/275 |
| 3,474,974 | 10/1969 | Wood | 241/275 |
| 3,606,182 | 9/1971 | Warren | 241/275 |
| 3,936,979 | 2/1976 | Fuerst | 241/275 X |
| 3,955,767 | 5/1976 | Hise | 241/275 |

*Primary Examiner*—Roy Lake
*Assistant Examiner*—Howard N. Goldberg
*Attorney, Agent, or Firm*—Chernoff & Vilhauer

[57] ABSTRACT

Centrifugal impact crusher machines have a rotating impeller table on which are mounted table liners and shoes for directing rock, or other material to be crushed, dispersed by a centrally mounted feed cone positioned on the rotating table outwardly against stationary anvils. The herein disclosed machine is comprised of impeller shoes which are removably attached to table mounted brackets by means of pins for facilitating quick easy removal and which have tapered working faces for promoting even wear and longer life. The impeller table liners are portioned respectively into first segments, which are positioned beneath and forwardly adjacent to their associated shoes and held down by the weight thereof, and second segments having lips which are arranged for fitting under the table feed cone, thus permitting these former segments to be replaced without need for replacement of the latter segments and both segments to be removed quickly. The second table liner segments include inclined ramp portions located adjacent to the leading edge of the first segments for directing the rock upwardly from the table face into the faces of the shoes thereby lessening wear of the uncovered portions of the first segments and increasing the efficiency of the shoes.

3 Claims, 5 Drawing Figures

FIG. 1
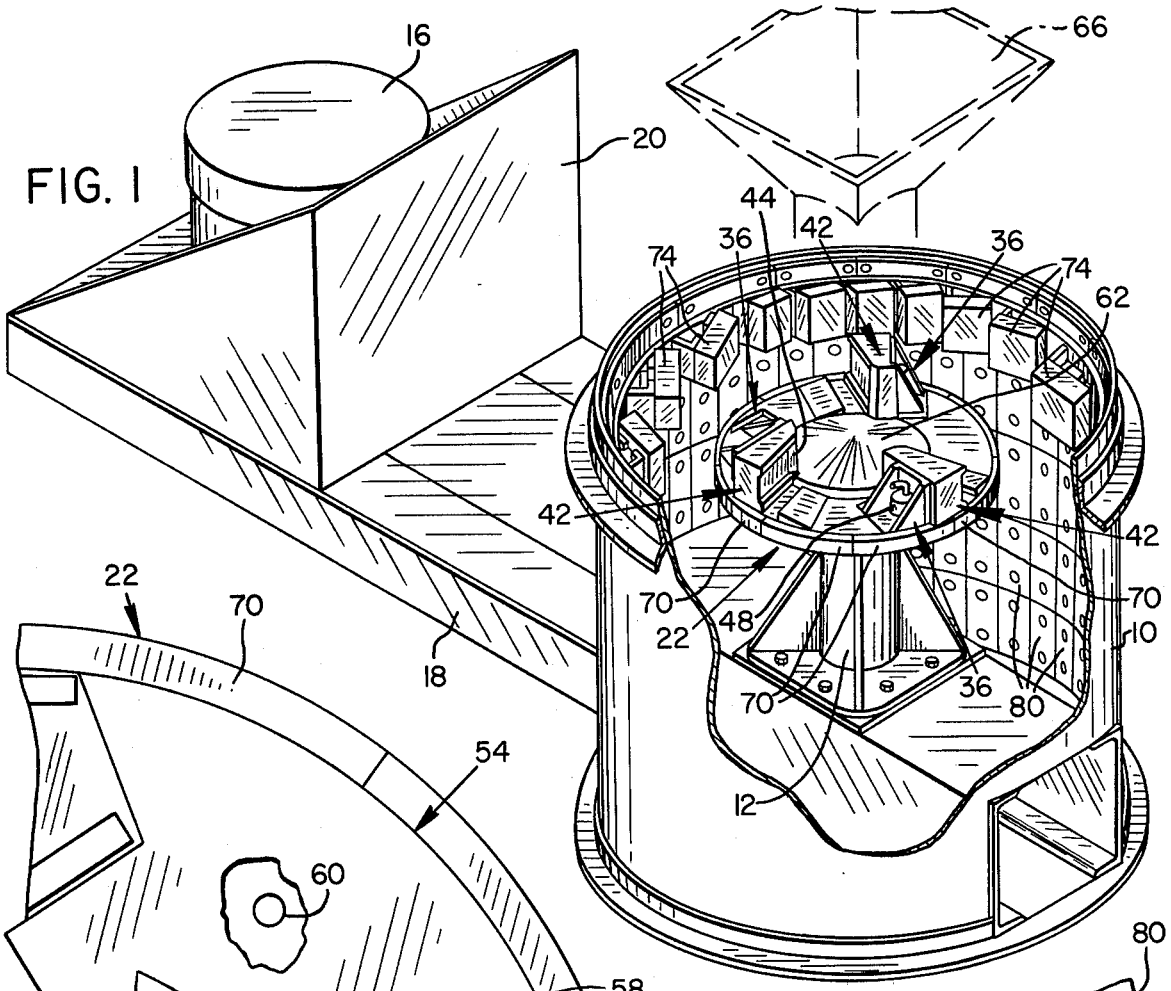
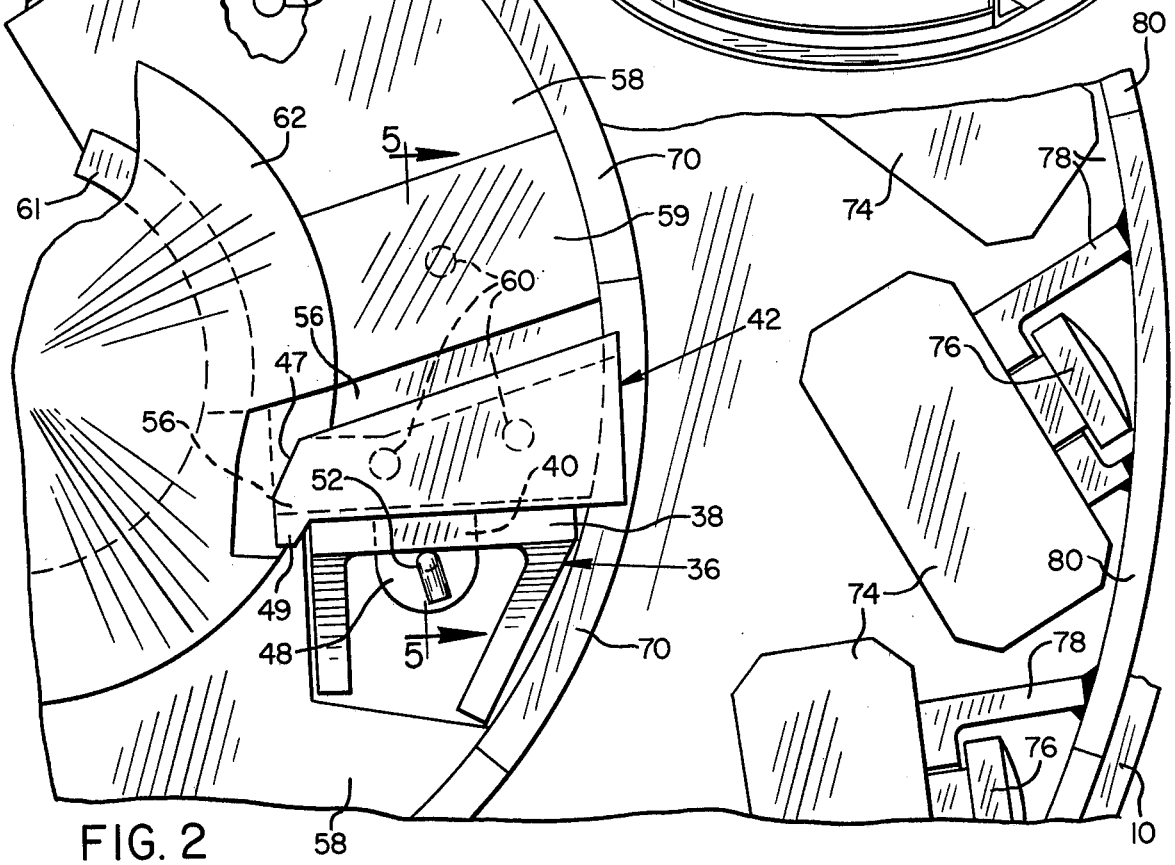
FIG. 2

70
72
34
54
58
32
24
61
64
68
28
30
62
12
14
26
22
42
46
52
48
59
44
74
36
38
40
50
56
60
63
65

CENTRIFUGAL IMPACT ROCK CRUSHERS

BACKGROUND OF THE INVENTION

This invention relates to improvements in crusher machines of the centrifugal impact type.

In crushing rock or other crushable materials with a machine of the type wherein the material is impacted against stationary anvils from a rotating impeller table, the rock causes rapid wear of the impeller table. Therefore, replaceable wear resistant liners are mounted on the table, and replaceable impeller shoes are mounted on top of the liners for directing the rock outwardly toward the anvils which, accordingly, must be replaced as wear occurs.

In the prior art crushers of the centrifugal impact type, such as that shown for example in Warren U.S. Pat. No. 3,606,182, the liners are bolted to the impeller table. As a result, replacement of the liners requires removal of several bolts. In addition, that portion of the liner which is located near the face of the shoe wears faster than that portion of the liner further removed from it due to the build up of rock near the shoe. However, since the liners are of one piece construction, the entire liner must be replaced when a portion of it becomes excessively worn, resulting in unnecessary expense.

Also the impeller shoes of the prior art crusher, tend to wear unevenly, since a large portion of the rock strikes their inner portions, and hence the shoes must be replaced prematurely further increasing the operating cost of the crushers.

As a result of the aforesaid disadvantages, the prior art crushers must be shut down frequently, and for long intervals, in order to effect replacement of the impeller table components, with the loss of considerable operation time. Furthermore, many of the components must be replaced before they are fully worn, thereby increasing the cost of operating the crushers.

GENERAL STATEMENT OF THE INVENTION

In its basic concept, the rock crusher of the present invention comprises the following improvements directed to overcoming the aforementioned disadvantages of prior art machines: the impeller shoes have forwardly tapered faces located on their inner ends causing them to wear evenly; the impeller table liners are portioned into, first segments which are located under and forwardly adjacent to their associated shoes, and, second segments which are located away from their associated shoes, the first segments being secured to the impeller table by the shoes and the second segments being secured to the table by tounge and groove joinder with the first segments and by integral lips which are engaged by the central feed cone; and the second segments have inclined ramps located adjacent to the leading edges of the first segments for directing the rock off the table and over the exposed portions of the first segments and onto the center portion of the shoes.

The foregoing and other objects, features and advantages of the present invention will be more readily understood upon consideration of the following detailed description taken in conjunction with the accompanying drawings.

BRIEF DESCRIPTION OF THE DRAWINGS

FIG. 1 is a pictorial view of a preferred embodiment of the rock crusher of the present invention, partially broken way to show hidden detail.

FIG. 2 is a fragmentary plan view of a portion of the rock crusher of FIG. 1, showing the operative elements of the invention.

DETAILED DESCRIPTION OF A PREFERRED EMBODIMENT

Figures 3, 4, 5:
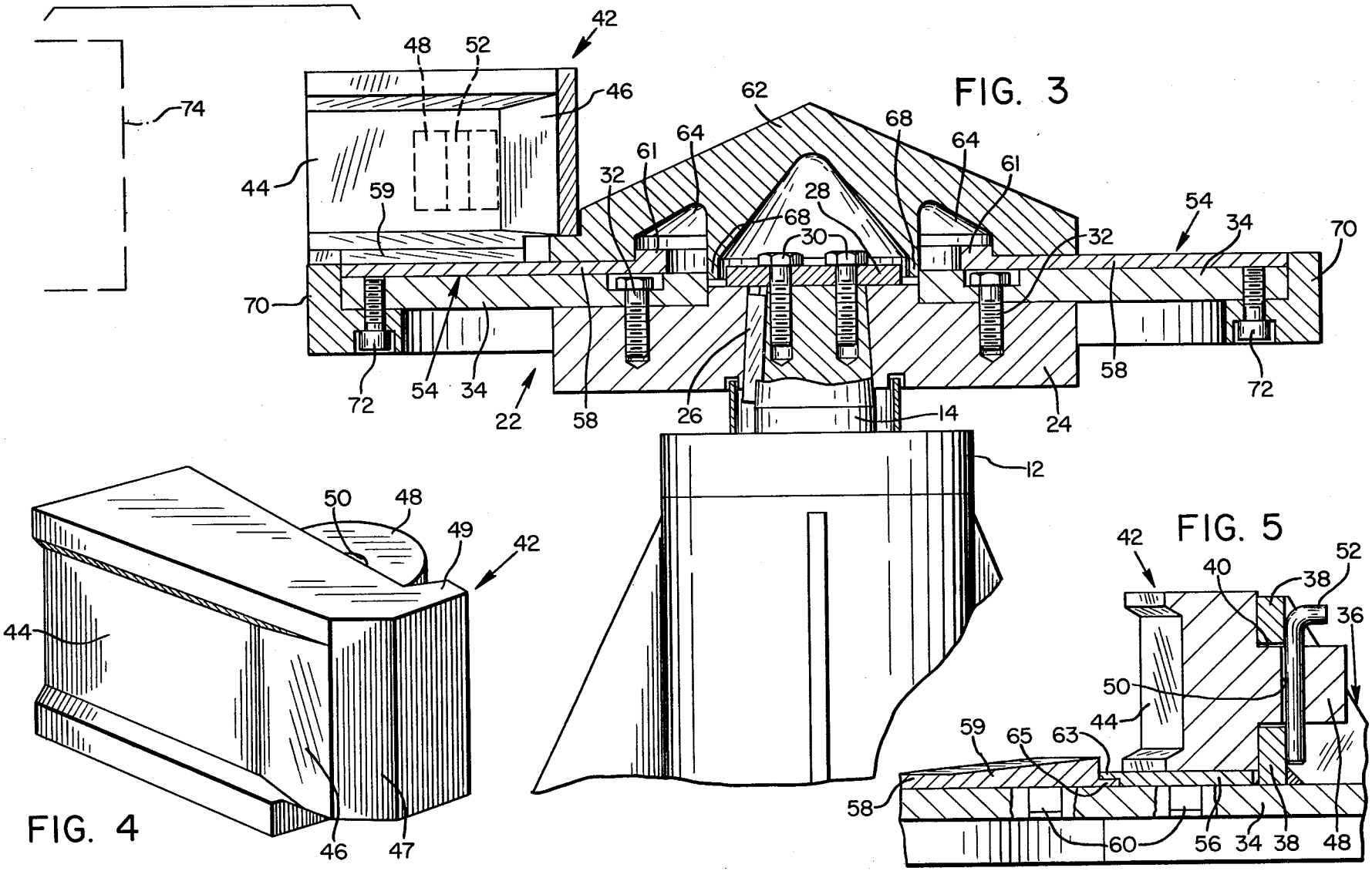
FIG. 3 is a fragmentary elevation, partially in section, showing the impeller table of the rock crusher of FIG. 1.
FIG. 4 is a pictorial view, at an enlarged scale, of one of the impact shoes shown in FIG. 3.
FIG. 5 is a fragmentary sectional view taken on line 5—5 of FIG. 2.

Referring to FIG. 1 of the drawings, the rock crusher of the present invention includes a cylindrical housing 10 into which the operative elements of the invention are mounted. Located medially in the housing is a pedestal 12 which journals a drive shaft 14, FIG. 3. The drive shaft is driven at a high speed by an external motor 16 through a suitable drive train (not shown). The drive shaft preferably is rotated at a speed between 700 and 1500 R.P.M. A rigid frame 18 interconnects the motor and housing 10, and a shield 20 protects the motor from flying rocks.

Referring now to FIG. 3, mounted on top of drive shaft 14 is an impeller table 22. In the embodiment illustrated the impeller table comprises a hub 24 which fits over the end of the drive shaft and which is fixed rotatably thereto by a key 26. The hub is fixed to the shaft axially by means of plate 28 and bolts 30. Attached by bolts 32 to the upper surface of the hub is an annular disk 34.

Joined to the outer portion of the upper surface of disk 34, at equally spaced intervals, are impeller shoe mounting brackets 36, FIG. 2. In the embodiment illustrated there are three such brackets; however, a greater or lesser number could be employed. The brackets generally are U-shaped in cross section and have planar mounting walls 38 which are oriented radially on the impeller table and have rectangular windows 40 passing centrally therethrough.

Mounted to the front faces of walls 38 are impeller shoes 42, FIG. 4, which are generally rectangular in shape and have wear-resistant working faces 44 recessed medially therein. The shoe faces 44 are located at an angle which is negative with respect to removal thereby angling them rearwardly toward their centers, preferably at an angle ranging between 17° and 20° from the radial, in order to more efficiently direct the rocks radially outward. Tapered wedges 46 are located at the inner ends of the recessed portions of faces 44 making this section of the faces nearly parallel with a radial line extending through the tips of the shoes, thus augmenting the thickness of face material at this normally high wear area and providing a more nearly even wear rate across the face. In addition the ramp effect caused by the wedges directs the material outwardly on the impeller shoes so that a large portion of it strikes the shoes near their radial portion.

The inner edge of the shoes extend inwardly past mounting brackets 36 and have angled faces 47 for directing rock away from the mounting brackets. It will be noted that wedges 46 increase the length of faces 47 thereby increasing their effectiveness. Skirts 49 extend from the inner end of the shoes rearwardly over a portion of the mounting brackets further directing the rock off of the brackets.

Lugs 48, projecting rearwardly from the rear surfaces of the impeller shoes, are dimensioned for communicating with windows 40 and have vertical bores 50 passing therethrough. The bores are arranged so that they are located rearwardly of walls 38 when the lugs are inserted into the windows. Fasteners, such as pins 52, fit snugly through bores 50 securing the shoes to the brackets. Thus the shoes can be replaced quickly and easily by removal of pins 52.

Replaceable planar table liners 54 of a wear resistant material are mounted on the impeller table to protect it from the abrasive action of the moving rock. One liner extends between each adjacent bracket 36, and each liner is comprised of two major segments: (1) a first segment 56 which is generally trapazoidal in plan view and which is positioned under and forwardly adjacent to its associated shoe and held onto the impeller table by the weight of its associated shoe; and (2) a second liner segment 58 which does not contact the shoe. The second segments 58 of the table liners preferably have upwardly inclined ramp portions 59 located adjacent the leading edge of the first segments for deflecting the rock upwardly over the uncovered portions of the first segments against the middle portions of the faces 44 of the shoes.

The leading edge of each first segment has a projection 63 which fits over a conforming tab 65 integral with the edge of the associated second section, transferring the weight of the shoe through the first section to hold down the second section. Each liner segment has two downwardly facing pins 60 which fit into conforming openings, located in disk 34 of the impeller table, for indexing the segment on the table and preventing its displacement during rotation of the table. The second table liner segments extend radially inwardly past the inner end of the shoes and have upwardly facing lips 61 located at their inner edges. The feed cone 62, which rests medially on the impeller table 22, has a radial recess 64 which receives lips 61 and thus restrains these segments 58 of the table liners against radial displacement.

The feed cone has a rather shallow angle which urges rock fed from a central hopper 66 outwardly onto the impeller table. The feed cone is positioned and retained against radial displacement by an anular lip 68 which engages the inner edge of disk 34. The feed cone is massive and therefore need be fixed to the impeller table only by its own weight.

Located around the periphery of the impeller table are segmented edge liners 70 having wear resistant faces. The edge liners extend partially under disk 34 and are mounted removably thereto by means of bolts 72. Thus all the working surfaces of the impeller table are protected by replaceable liners.

Circumscribing the impeller table are a plurality of evenly spaced wear resistant anvils 74. The anvils are coplanar with shoes 42 so that rock thrown off of the table by centrifugal force is impacted against the anvils where it is shattered. The anvils are symmetrical about their vertical center lines and are retained rotatably by intregal pins 76 in holders 78 which are attached to the inner wall of housing 10. Thus the anvils can be rotated 180° when one side wears, thereby effectively doubling their operative life.

Replaceable plates 80 are mounted around the inner surface of the housing to protect it from abrasion by the flying rocks.

OPERATION

The rock crusher of the present invention operates in much the same manner as centrifugal impact rock crushers of the prior art. With impeller table 22 rotating, rock or other crushable material is fed from hopper 66 centrally onto feed cone 62. Centrifugal force urges the rock outwardly from the feed cone onto table liners 54 where it continues to slide radially outwardly as well as sliding circumferentially against the direction of impeller table rotation. Thus the rock builds up against shoes 42 where it continues to be directed radially outwardly to strike anvils 74 and be fractured into smaller pieces, thereby causing the heaviest wear to occur on the inner portions of the shoes and the portions of the table liners which lie adjacent to the shoes.

It will be noted that ramps 59 of the present invention direct the rock upwardly over the portions of table liners located adjacent to the shoes, thus lessening the abrasion of this high wear area and onto the medial portions of the shoes for more efficient dispersal. Since a larger portion of the rock strikes the shoes near their inner edges, tapered portions 46 direct the rock outwardly on the faces of the shoes causing the shoes to wear more evenly. In addition, the additional material added to the shoes in this area augments them to further even wear across their faces. Also the additional length added to the inner faces 47 of the shoes, along with the effect of skirts 49 prevents the rock from striking mounting brackets 36.

As the operative components wear due to the abrasive action of the rock, they are easily and quickly replaced. Shoes 42 are removed merely by removal of pins 52. The first segments 56 of the table liners then are free to be removed without the necessity of removing or replacing the remaining portions of the table liners. To remove the second segments 58, feed cone 62 also must be removed. However, since the portions of each table liner adjacent to the shoe is exposed to continual abrasion by the rock it wears faster than the remainder of the table liner. Therefore, in most instances replacement of the first table liner segments can be made without replacement of the second table liner segments. Accordingly, there is a significant savings in down time and cost of parts in the present invention.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. In a rock crusher of the centrifugal impact type having an impeller table rotating about a vertical axis for receiving rock on a centerally located feed cone and throwing the rock outwardly against a plurality of anvil surfaces, the rock crusher having at least two wear resistant impeller table liners removably mounted to the upper surface of the impeller table, and having one impeller shoe for each impeller table liner mounted to the impeller table above the impeller table liners for directing the rock radially outwardly, the improvement comprising:

a. each impeller table liner being divided into a first segment and a second segment, and securing means for securing both of said segments to said impeller table, allowing replacement of the first segment without removal of the second segment, b. said first segment configured for being located under and forwardly adjacent to its associated impeller shoe and being further secured to the impeller table thereby, and c. a projection integrally joined to the edge of each first segment, and a tab integrally joined to the edge of the second segment, said projection and said tab being adapted for engagement, with said projection overlying said tab, when said segments are installed on said impeller table, so that said first segment hold said second segment on said impeller table.

2. The rock crusher of claim 1 including lips located along the radially inward margins of said second segments of said impeller table liners, said lips arranged for being engaged by said feed cone, when said feed cone is positioned on said impeller table, in a manner for preventing radially outward displacement of said second segments.

3. The rock crusher of claim 1 wherein said securing means comprises pins depending from both segments of said impeller table liners, and said impeller table having conforming openings for receiving said pins, thereby preventing circumferential displacement of said impeller table liners on said table.

* * * * *